US007152857B2

(12) United States Patent
Hiramoto et al.

(10) Patent No.: US 7,152,857 B2
(45) Date of Patent: Dec. 26, 2006

(54) PAPER FEED AND OUTPUT ASSEMBLY, AND IMAGE FORMING APPARATUS

(75) Inventors: Yoshiaki Hiramoto, Yamatokoriyama (JP); Akira Nakashima, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 603 days.

(21) Appl. No.: 10/458,639

(22) Filed: Jun. 11, 2003

(65) Prior Publication Data

US 2003/0230841 A1 Dec. 18, 2003

(30) Foreign Application Priority Data

Jun. 12, 2002 (JP) ..... 2002-171674

(51) Int. Cl.
*B65H 83/00* (2006.01)
*B65H 3/44* (2006.01)
*B65H 39/11* (2006.01)

(52) U.S. Cl. ..... 271/3.14; 271/9.08; 271/294

(58) Field of Classification Search ..... 271/288, 271/292–294, 298, 9.05, 9.08, 9.11, 3.14, 271/4.01, 3.19, 291; 399/369, 82, 83, 85, 399/367

See application file for complete search history.

(56) References Cited

U.S. PATENT DOCUMENTS 4,660,820 A * 4/1987 Shino et al. ..... 271/9.08
4,709,915 A * 12/1987 Ishikawa et al. ..... 271/288
4,828,415 A * 5/1989 Hirono et al. ..... 400/605
5,435,536 A * 7/1995 Adachi et al. ..... 271/9.03
5,580,039 A * 12/1996 Takehara et al. ..... 270/58.11
5,864,732 A * 1/1999 Kato ..... 399/43
5,988,632 A * 11/1999 Tomishige et al. ..... 271/201
6,249,658 B1 * 6/2001 Inui et al. ..... 399/82
6,325,368 B1 * 12/2001 Ikeda et al. ..... 271/3.03
6,371,476 B1 4/2002 Isogai et al.
6,415,116 B1 * 7/2002 Sumiyama et al. ..... 399/82

FOREIGN PATENT DOCUMENTS

JP 2-178149 A 7/1990
JP 2-286546 A 11/1990
JP 11-278742 A 10/1999

* cited by examiner

*Primary Examiner*—Patrick Mackey
*Assistant Examiner*—Jeremy R Severson
(74) *Attorney, Agent, or Firm*—Birch, Stewart, Kolasch & Birch, LLP

(57) ABSTRACT

An image forming apparatus, which has sophisticated functions of feeding recording paper of various sizes selectively and of sorting printed paper, is reduced in size. The feed bin sorters, the output bin sorters, and the output tray are arranged in tiers. Pre-printed paper is supplied from any of the feed bin sorters, and printed paper is delivered to any of the output bin sorters or the output tray.

6 Claims, 8 Drawing Sheets

Fig.4

41

| User Name | Paper loading height (from floor) (cm) | Paper collection height (from floor) (cm) |
|---|---|---|
| Default | 60 | 70 |
| A | 30 | 30 |
| B | 30 | 50 |
| C | 50 | 50 |
| D | 50 | 70 |
| E | 70 | 70 |
| F | 70 | 80 |
| G | 80 | 80 |

PAPER FEED AND OUTPUT ASSEMBLY, AND IMAGE FORMING APPARATUS

BACKGROUND OF THE INVENTION

1. Field of the Invention

The present invention relates to a paper feed and output assembly which supplies and delivers recording paper, and also relates to an image forming apparatus.

1. Related Art

This type of image forming apparatus often combines a copier function, a printer function, a facsimile transmission function and more, due to the development of multifunction devices. Alternatively or additionally, the image forming apparatus may have other functions of feeding recording paper of various sizes selectively from separate paper cassettes and sorting printed paper into more than one bin sorter. On the other hand, the market has strongly requested compact image forming apparatus. However, these paper cassettes and bin sorters are too bulky to realize miniaturization of the image forming apparatus.

FIG. 8 is a side view which exemplifies such a conventional image forming apparatus. This image forming apparatus is equipped with a document feeder 101 in which an original document is placed, a scanner 102 for scanning an original document, paper cassettes 103 for separately storing recording paper of various sizes, a transport unit 104 for pulling out and transporting recording paper from any of the paper cassettes 103, a printer 105 by which an image of an original document scanned by the scanner 102 is recorded on recording paper which is transported from the transport unit 104, and an output unit 106 for handling printed paper. The output unit 106 delivers printed paper from an output port 107 to a top output tray 108 or from an output port 110 to any of bin sorters 109. In the latter case, a suitable bin sorter 109 is vertically displaced to the output port 110 so as to receive printed paper therefrom.

As apparent from FIG. 8, the paper cassettes 103 and the bin sorters 109 occupy an enormous space relative to the entire image forming apparatus, hindering miniaturization of the image forming apparatus.

In this respect, techniques for producing a compact image forming apparatus are proposed in Japanese Patent Laid-open Publication Nos. H2-286546 and H2-178149, to name a few. These techniques utilize a single tray as a paper cassette and as an output bin. The single tray supplies pre-printed paper to the image forming apparatus and receives printed paper therefrom.

However, since the single tray combines the functions of a paper cassette and an output bin, the techniques disclosed in these publications fail to impart sophisticated functions of feeding recording paper of various sizes selectively and sorting printed paper.

SUMMARY OF THE INVENTION

The present invention is made in view of this problem. An object of the invention is to provide a paper feed and output assembly and an image forming apparatus which have sophisticated functions of feeding recording paper of various sizes selectively and sorting printed paper, and which are available in a reduced size.

In order to solve this problem, the present invention concerns a paper feed and output assembly attached to an image forming apparatus, for supplying pre-printed paper to the image forming apparatus and receiving printed paper therefrom. This paper feed and output assembly comprises:

a plurality of feed bin sorters for storing pre-printed paper; a plurality of output bin sorters for storing printed paper; and hold and elevation means for holding the feed bin sorters and the output bin sorters in tiers and in a vertically displaceable manner, and for vertically displacing any one of the feed bin sorters to a feed position in the image forming apparatus and vertically displacing any one of the output bin sorters to an output position in the image forming apparatus.

According to the paper feed and output assembly of the invention, the feed bin sorters and the output bin sorters are held in tiers and in a vertically displaceable manner. With any one of the feed bin sorters being vertically displaced to a feed position in the image forming apparatus, paper can be supplied from this feed bin sorter to the image forming apparatus. Further, with any one of the output bin sorters being vertically displaced to an output position in the image forming apparatus, paper can be delivered from the image forming apparatus to this output bin sorter. Owing to this structure, the paper feed and output assembly can do without conventional paper cassettes and can therefore realize an image forming apparatus in a reduced size.

As a preferable mode of the invention, when pre-printed paper is loaded in any one of the feed bin sorters, the hold and elevation means separates the feed bin sorter to be loaded with pre-printed paper, and an upper bin sorter which locates above the feed bin sorter to be loaded with pre-printed paper.

In this arrangement, any one of the feed bin sorters to be loaded with pre-printed paper is separated from an upper bin sorter which locates above this feed bin sorter, so that a wide space can be created over the feed bin sorter. This space not only helps a user to find the feed bin sorter to be loaded with recording paper, but also enables easy loading of recording paper into the feed bin sorter.

As a further preferable mode of the invention, the hold and elevation means vertically displaces the feed bin sorter to be loaded with preprinted paper, to a position which is prescribed in advance.

For example, if the feed bin sorter to be loaded with pre-printed paper is raised enough, a user can load recording paper into the feed bin sorter more easily.

As another preferable mode of the invention, the hold and elevation means separates any one of the output bin sorters which has received printed paper from the image forming apparatus, and an upper bin sorter which locates above the output bin sorter which has received printed paper.

In this arrangement, any one of the output bin sorters which has received printed paper is separated from an upper bin sorter which locates above this output bin sorter, so that a wide space can be created over the output bin sorter. This space not only helps a user to find the output bin sorter from which recording paper should be collected, but also enables easy collection of recording paper from the output bin sorter.

As further another preferable mode of the invention, the hold and elevation means vertically displaces the output bin sorter which has received printed papers, to a position which is prescribed in advance.

For example, if the output bin sorter which has received printed paper is raised enough, a user can collect recording paper from the output bin sorter more easily.

Moreover, the present invention concerns an image forming apparatus which comprises a paper feed and output assembly, and which receives pre-printed paper from the paper feed and output assembly and delivers printed paper thereto. In this image forming apparatus, the paper feed and output assembly comprises: a plurality of feed bin sorters for storing pre-printed paper; a plurality of output bin sorters for storing printed paper; and hold and elevation means for holding the feed bin sorters and the output bin sorters in tiers and in a vertically displaceable manner, and for vertically displacing any one of the feed bin sorters to a feed position in the image forming apparatus and vertically displacing any one of the output bin sorters to an output position in the image forming apparatus.

Owing to this structure, the image forming apparatus can do without conventional paper cassettes and is therefore available in a reduced size.

BRIEF DESCRIPTION OF THE DRAWINGS

FIG. 4 represents a custom setting table utilized for the feed/output unit of the image forming apparatus shown in FIG. 1.

DESCRIPTION OF PREFERRED EMBODIMENTS

An embodiment of the present invention is hereinafter described with reference to the drawings.

Figure 1:
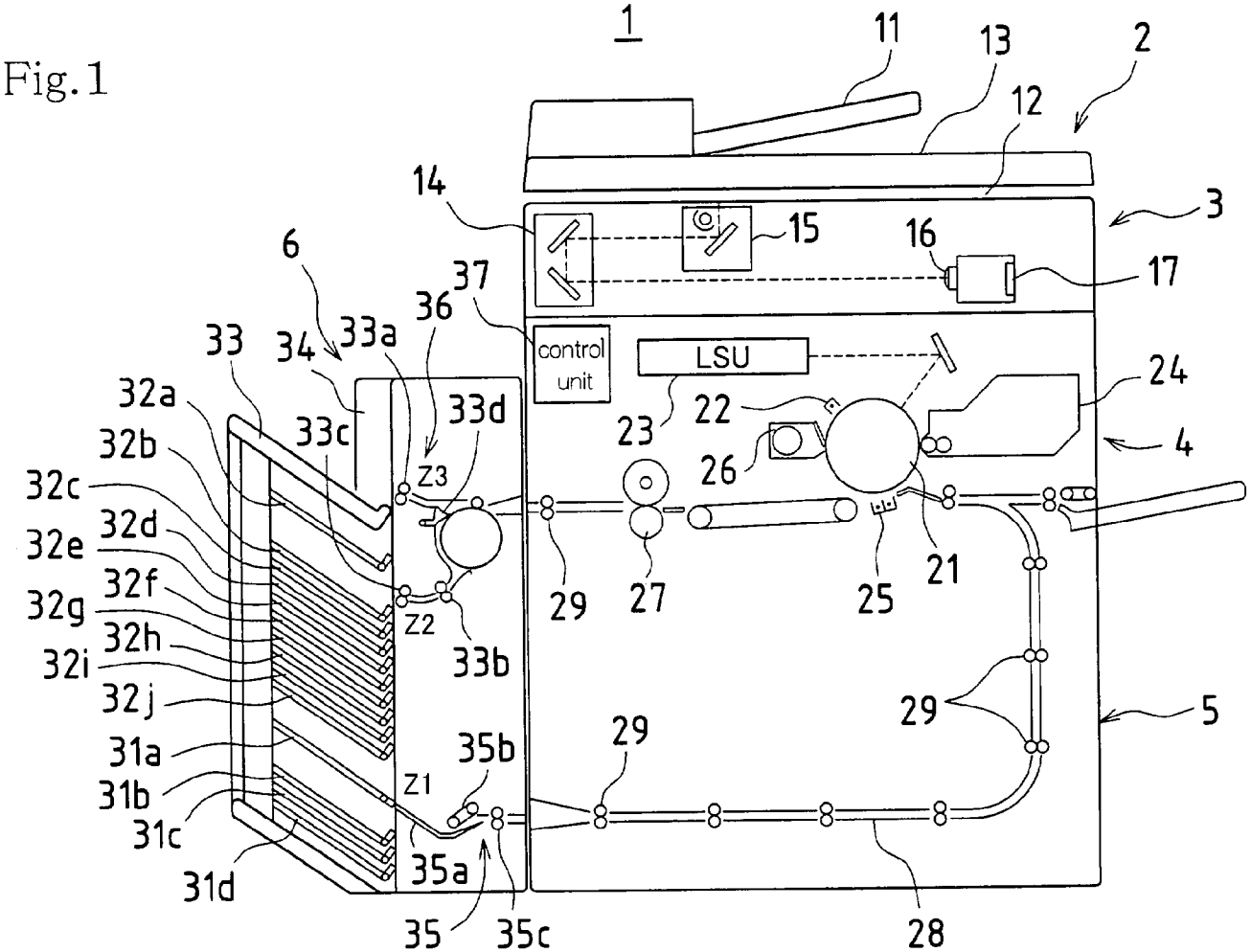
FIG. 1 is a side view showing the structure of an image forming apparatus according to an embodiment of the invention.

FIG. 1 is a side view of an image forming apparatus according to an embodiment of the invention. The image forming apparatus 1 of FIG. 1 is a multifunction device which combines a copier function, a printer function, a facsimile transmission function and the like. The image forming apparatus 1 is equipped with a document transport unit 2, a scanner 3, a printer 4, a recording paper transport unit 5, and a feed/output unit 6.

When an original document is placed in a document feed tray 11, the document transport unit 2 sends and aligns the document on a platen 12. Once an image of the document is scanned by the scanner 3, the document transport unit 2 transports and delivers the document to a document output tray 13.

The scanner 3 performs an action of moving first and second scanning units 14, 15, with keeping them in a given speed relationship relative to each other. When the first scanning unit 14 exposes an image of a document placed on the platen 12, reflected light from the document is led to a lens 16 by the first and second scanning units 14, 15. The lens 16 focuses the image of the document on an optical-electrical converter or charge-coupled device (hereinafter called CCD) 17. The CCD 17 captures an image of a document by repeatedly scanning the document in the main scanning direction, and outputs image data for the document image.

The printer 4 receives image data from the scanner 3 or from an external device, and records an image on recording paper according to the image data. The printer 4 is equipped with a photosensitive drum 21, a charger 22, a laser scanning unit (hereinafter called LSU) 23, a developer 24, a transfer apparatus 25, a cleaner 26, a static eliminator (not shown) , a fuser 27, and others. The photosensitive drum 21, rotating in one direction, has its surface cleaned by the cleaner 26 and the static eliminator. Then, the charger 22 uniformly charges the cleaned drum surface. The LSU 23 modulates an optical beam according to image data and employs the modulated optical beam in order to scan the surface of the photosensitive drum 21 repeatedly in the main scanning direction. As a result, an electrostatic latent image is formed on the surface of the photosensitive drum 21. The developer 24 develops the electrostatic latent image by supplying toner to the surface of the photosensitive drum 21, so that a toner image is formed on the surface of the photosensitive drum 21. The transfer apparatus 25 allows the toner image on the surface of the photosensitive drum 21 to be transferred to recording paper which is transported through the recording paper transport unit 5. The fuser 27 fixes the toner image on the recording paper by applying heat and pressure to the recording paper. This recording paper is further sent to the feed/output unit 6 via the recording paper transport unit 5.

The recording paper transport unit 5 has a transport path 28 for receiving recording paper from the feed/output unit 6, sending it to the printer 4 and returning the paper to the feed/output unit 6. The recording paper transport unit 5 is also equipped with pairs of transport rollers 29 for transporting recording paper.

On the one hand, the feed/output unit 6 stores pre-printed paper and supplies the pre-printed paper to the recording paper transport unit 5. On the other hand, the feed/output unit 6 receives printed paper from the recording paper transport unit 5 and stores the printed paper. This feed/output unit 6 is composed of feed bin sorters 31*a*–31*d* which separately store pre-printed paper according to the size, output bin sorters 32*a*–32*j* which store printed paper, a top output tray 33, an elevator drive unit 34 which holds the feed bin sorters 31*a*–31*d* and the output bin sorters 32*a*–32*j* in a vertically displaceable manner and which effects vertical displacement of these bin sorters, a pullout unit 35 which pulls out pre-printed paper from any of the feed bin sorters 31*a*–31*d* and supplies the pre-printed paper to the recording paper transport unit 5, an output unit 36 which receives printed paper from the recording paper transport unit 5 and delivers the printed paper to any of the output bin sorters 32*a*–32*j* or the output tray 33, and a control unit 37 which has total control over the feed/output unit 6.

Figure 2:
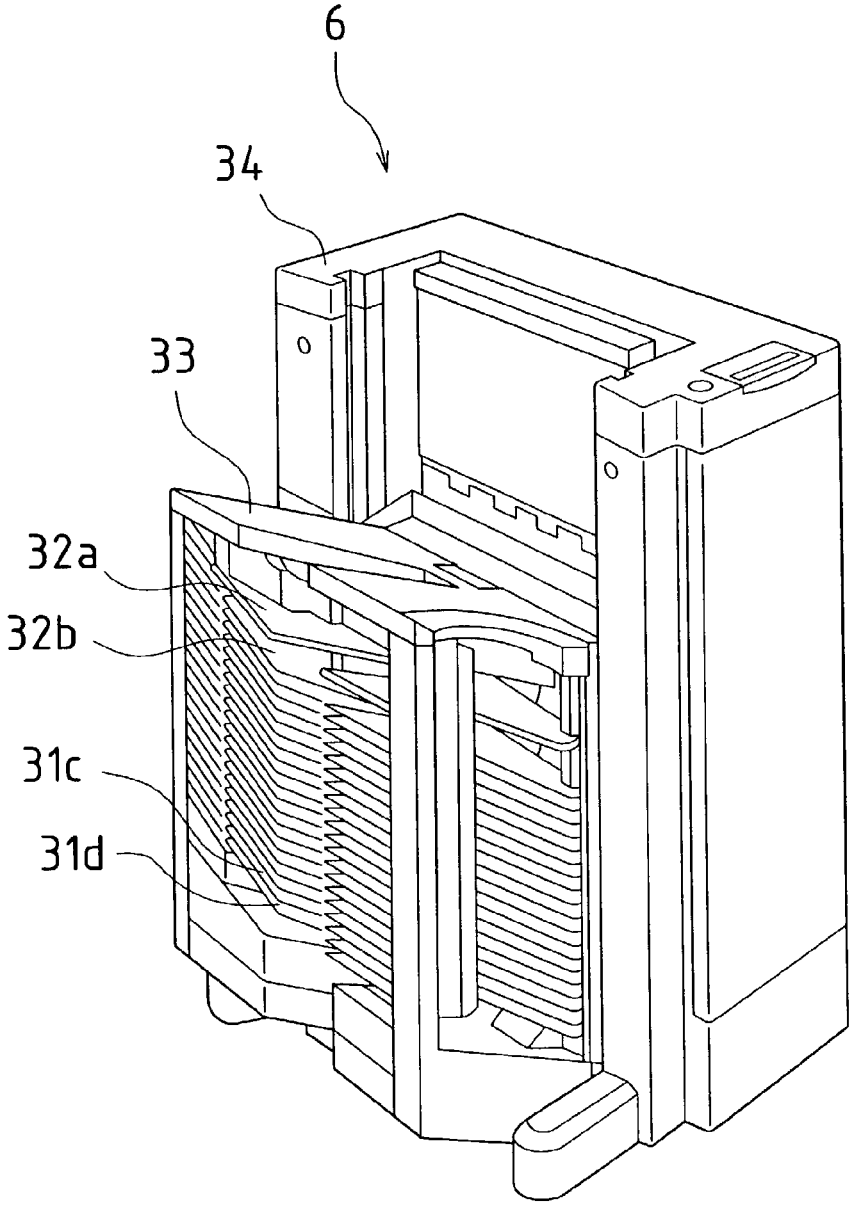
FIG. 2 is a perspective view showing an external appearance of a feed/output unit of the image forming apparatus shown in FIG. 1.

FIG. 2 is a schematic structural view of the feed/output unit 6. As apparent from FIG. 2, the feed bin sorters 31*a*–31*d* and the output bin sorters 32*a*14 32*j* have the form of a tray and are arranged in tiers in an inclined manner.

Figure 3:
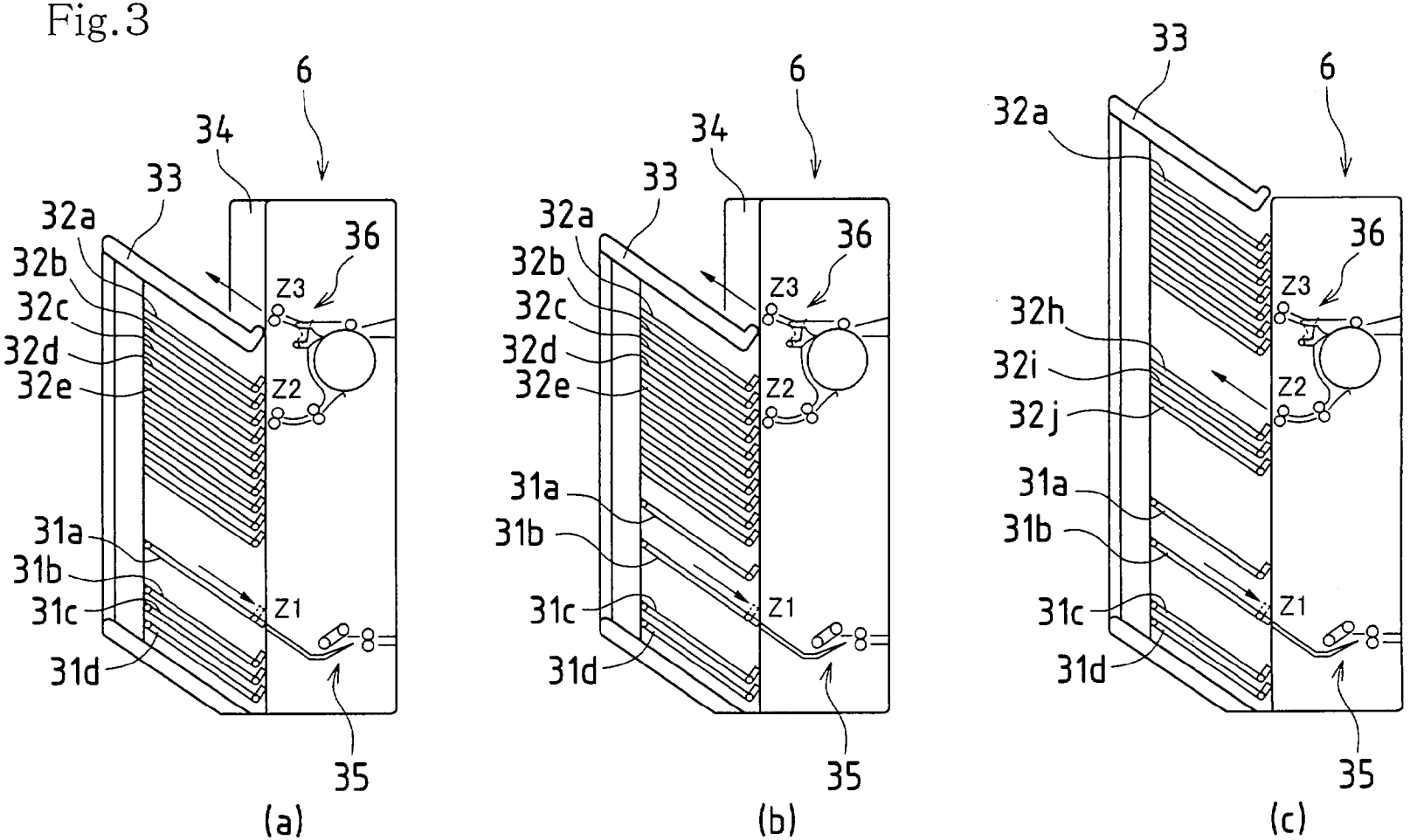
FIG. 3 illustrates different states of feed bin sorters and output bin sorters provided at the feed/output unit shown in FIG. 1.

In use, the four feed bin sorters 31*a*–31*d* of the feed/output unit 6 separately store pre-printed papers of, for example, B5, A4, B4 and A3 sizes. By controlling the drive of the elevator drive unit 34, the control unit 37 is capable of raising and lowering the feed bin sorters 31*a*–31*d* independently, and selectively effects vertical displacement of any of the feed bin sorters 31*a*–31*d* to the position Z1 in the pullout unit 35. In response to the control from the control unit 37, the pullout unit 35 pulls out preprinted paper one sheet after another from the feed bin sorter located at the position Z1, and sends this pre-printed paper through a guide 35*a*, a pair of pullout rollers 35*b*, and a pair of transport rollers 35*c*, to the transport path 28 in the recording paper transport unit 5. By way of example, to print on B5 recording paper, the feed bin sorter 31*a* is vertically displaced to the position Z1 in the pullout unit 35, as illustrated in FIG. 3(*a*). In this situation, the pullout unit 35 pulls out B5 recording paper from the feed bin sorter 31*a* and sends the paper to the recording paper transport unit 5. To print on A4 recording paper, the feed bin sorter 31*b* is vertically displaced to the position Z1 in the pullout unit 35, as illustrated in FIG. 3(*b*). Likewise, the pullout unit 35 pulls out A4 recording paper from the feed bin sorter 31*b* and sends the paper to the recording paper transport unit 5.

The output bin sorters 32*a*–32*j* and the output tray 33 receives printed paper delivered from the recording paper transport unit 5. By controlling the drive of the elevator drive unit 34, the control unit 37 is capable of raising and lowering the output bin sorters 32*a*–32*j* and the output tray 33 independently or together, and selectively effects vertical displacement of any of the output bin sorters 32*a*–32*j* or the output tray 33 to the position Z2 or Z3 in the output unit 36. The output unit 36 is provided with pairs of transport rollers 33*a*, 33*b*, 33*c* and a transport path switchover gate 33*d*. In response to the control from the control unit 37, the output unit 36 changes over the transport path switchover gate 33*d* such that printed paper is delivered via the pair of transport rollers 33*a* to an output bin sorter or the output tray 33 at the position Z3, or such that printed paper is delivered via the pairs of transport rollers 33*b*, 33*c* to an output bin sorter at the position Z2. For example, in the case shown in FIGS. 3(*a*) and (*b*), where the output tray 33 is vertically displaced to the position Z3 in the output unit 36, the output unit 36 delivers printed paper to the output tray 33. On the other hand, in the case shown in FIG. 3(*c*), where the output bin sorter 32*h* is vertically displaced to the position Z2 in the output unit 36, the output unit 36 delivers printed paper to the output bin sorter 32*h*.

For loading of recording paper in the feed bin sorters 31*a*–31*d*, a feed bin sorter to be loaded with recording paper is vertically displaced to an optional height. Besides, a bin sorter above this feed bin sorter is vertically displaced to expand a space between the two bin sorters (e.g. about 10 cm). This space not only enables easy loading of recording paper but also helps a user to find a feed bin sorter to be loaded with recording paper. Likewise, for collection of recording paper from the output bin sorters 32*a*–32*j*, an output bin sorter from which recording paper is collected is vertically displaced to an optional height. Besides, a bin sorter above this output bin sorter is vertically displaced to expand a space between the two bin sorters (e.g. about 10 cm). This space not only enables easy collection of recording paper but also helps a user to find an output bin sorter from which recording paper should be collected.

Concerning such actions, the control unit 37 creates and stores a custom setting table 41 as shown in FIG. 4, according to user's input on an input operation part (not shown). The custom setting table 41 is registered beforehand with a plurality of user names, and optional heights of a feed bin sorter and those of an output bin sorter associated with the respective user names. In this context, an optional height of a feed bin sorter associated with each user name is understood to be a desired height of a feed bin sorter to be loaded with recording paper, the value being set by each user within a predetermined allowance. Similarly, an optional height of an output bin sorter associated with each user name is understood to be a desired height of an output bin sorter from which recording paper is collected, the value being set by each user within a predetermined allowance. Additionally, standard heights are registered in association with a default user name.

Figure 5:
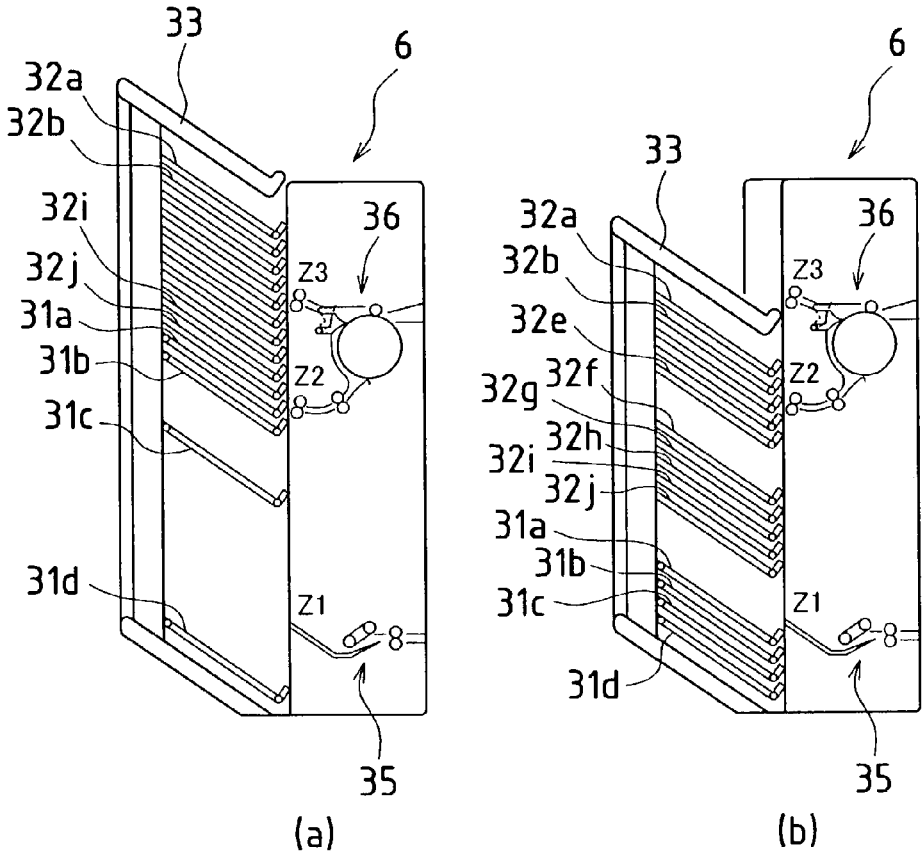
FIG. 5 illustrates further different states of the feed bin sorters and output bin sorters provided at the feed/output unit in the image forming apparatus shown in FIG. 1.

By way of example, if the user name G is entered for loading of B4 recording paper, the control unit 37 fetches, from the custom setting table 41, the height of a feed bin sorter associated with the user name G, i.e. 80 cm. Further, as shown in FIG. 5(*a*), the control unit 37 controls the drive of the elevator drive unit 34 such that the feed bin sorter 31*c* for storing B4 recording paper is vertically displaced to the height of 80 cm, along with vertical displacement of the upper feed bin sorter 31*b*. Thereby, the space between the feed bin sorters 31*b*, 31*c* expands to about 10 cm. As a result, when loading recording paper into the feed bin sorter 31*c*, a user does not have to stoop down in an unnatural posture. Besides, the wider space helps a user to find the feed bin sorter 31*c* to be loaded with B4 recording paper.

If the user name G is entered for a recording operation by the image forming apparatus 1, the control unit 37 fetches, from the custom setting table 41, the height of an output bin sorter associated with the user name G, i.e. 80 cm. By way of illustration, after recording paper is completely delivered to the output bin sorter 32*f*, the control unit 37 controls the drive of the elevator drive unit 34, as shown in FIG. 5(*b*), such that the output bin sorter 32*f* is vertically displaced to the height of 80 cm, along with vertical displacement of the upper output bin sorter 32*e*. Thereby, the space between the output bin sorters 32*e*, 32*f* expands to about 10 cm. As a result, when collecting recording paper from the output bin sorter 32*f*, a user does not have to stoop down in an unnatural posture. Besides, the wider space helps a user to find the output bin sorter 32*f* from which recording paper should be collected.

Figure 6:
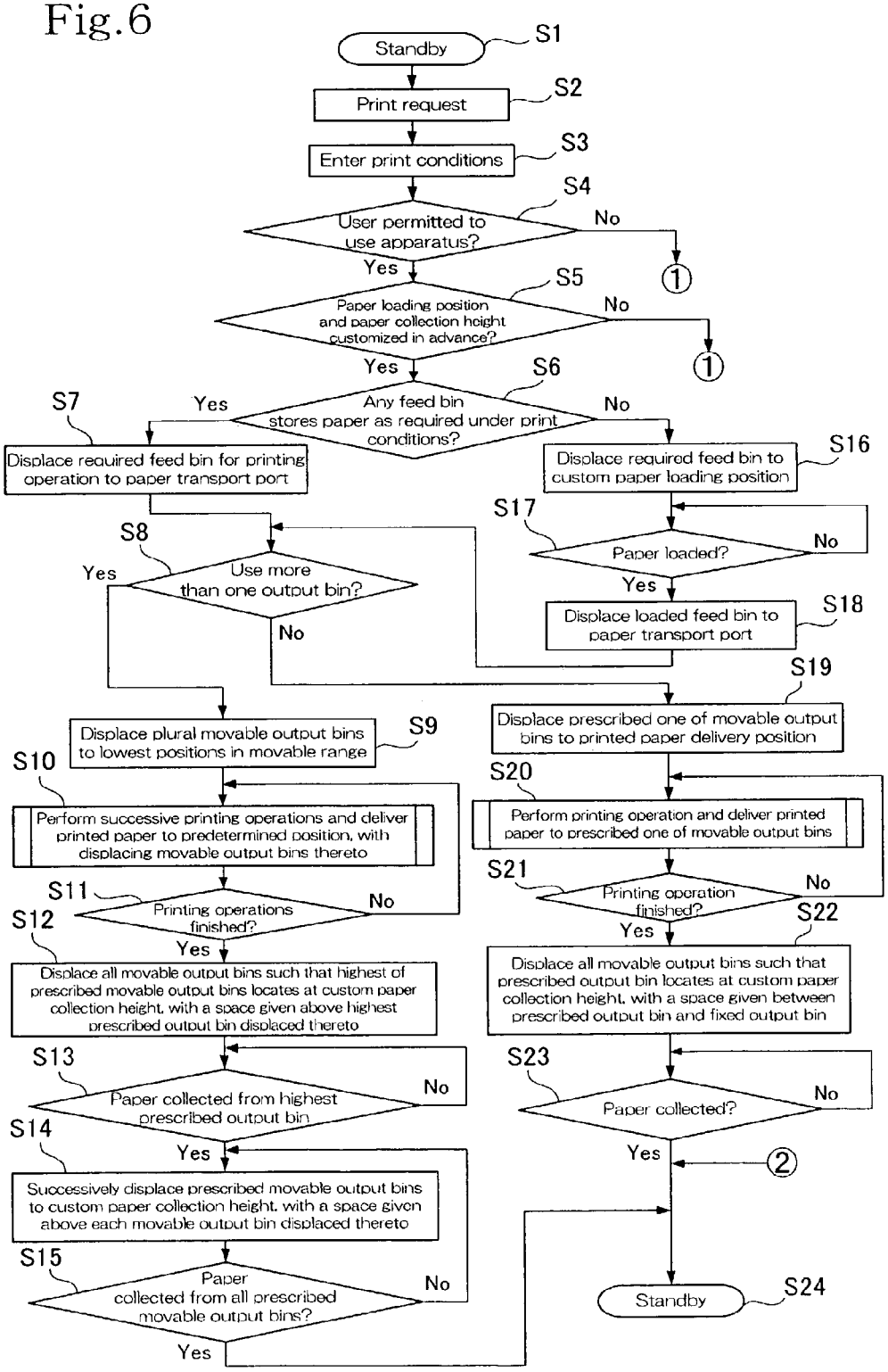
FIG. 6 is a flowchart which shows control processes in the feed/output unit of the image forming apparatus shown in FIG. 1.
Figure 7:
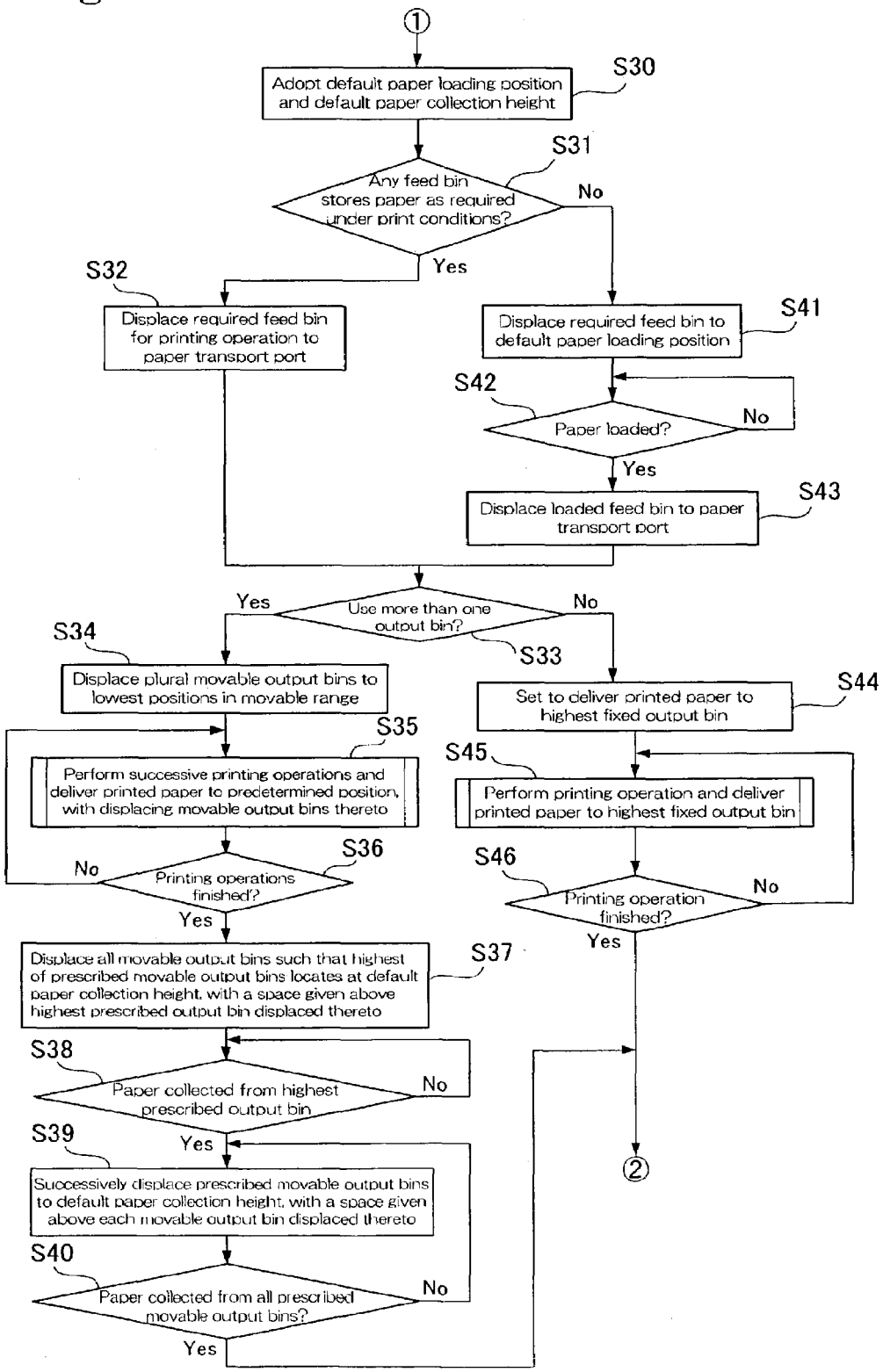
FIG. 7 is a flowchart which continues from FIG. 6 to show the control processes.

Referring next to the flowcharts in FIG. 6 and FIG. 7, the control unit 37 controls the feed/output unit 6 according to the following control processes.

To start with, in the stand-by mode (Step S1), the image forming apparatus 1 receives a request for copying or the like, namely, a print request (Step S2), followed by entry of input conditions or print conditions (Step S3). The print conditions include user name, size of recording paper, and processing method for printed paper. At this stage, the control unit 37 checks whether a printing operation is permitted in advance under the entered user name (Step S4). Further, the control unit 37 refers to the custom setting table 41 of FIG. 4 and judges whether the heights of a feed bin sorter and an output bin sorter are set beforehand in association with this user name (Step S5).

If a printing operation is permitted in advance under the entered user name (Yes in Step S4) and if the heights of a feed bin sorter and an output bin sorter are set beforehand in association with this user name (Yes in Step S5), the control unit 37 determines whether any feed bin sorter stores recording paper whose size agrees to a relevant print condition (Step S6). If there is a corresponding feed bin sorter (Yes in Step S6), the control unit 37 controls the drive of the elevator drive unit 34 in such a manner as to vertically displace the corresponding feed bin sorter to the position Z1 in the pullout unit 35 (Step S7). Consequently, recording paper can be pulled out of the corresponding feed bin sorter.

If there is no corresponding feed bin sorter (No in Step S6), the control unit 37 selects any of the feed bin sorters 31*a*–31*d*. Then, from the custom setting table 41, the control unit 37 fetches the height of a feed bin sorter associated with the user name. As already mentioned, this height is among the print conditions. Further, the control unit 37 controls the drive of the elevator drive unit 34 such that the selected feed bin sorter is vertically displaced to the height associated with the user name, along with vertical displacement of an upper bin sorter which locates above the selected feed bin sorter. Thereby, the two bin sorters are separated by a distance of about 10 cm (Step S16), which enables easy loading of recording paper in the feed bin sorter. Thereafter, the control unit 37 stands by until the selected feed bin sorter is loaded with recording paper whose size agrees to a relevant print condition (No in Step S17). Once proper recording paper is loaded (Yes in Step S17), the control unit 37 controls the drive of the elevator drive unit 34 in such a manner as to vertically displace the selected feed bin sorter to the position Z1 in the pullout unit 35 (Step S18). Consequently, recording paper can be pulled out of the selected feed bin sorter.

In the next step, the control unit 37 refers to a relevant print condition and decides whether to sort printed paper into more than one output bin sorter (Step S8). To deliver printed paper simply to an output bin sorter (No in Step S8), the control unit 37 controls the drive of the elevator drive unit 34 in such a manner as to vertically displace any of the output bin sorters 32*a*–32*j* to the position Z2 or Z3 in the output unit 36 (Step S19). At this stage, it is possible to pull recording paper out of a certain feed bin sorter and to deliver recording paper to a certain output bin sorter. In this situation, the pullout unit 35 pulls out pre-printed paper from the feed bin sorter and sends the paper to the recording paper transport unit 5. After the printer 4 records an image on this recording paper, the output unit 36 delivers the printed paper to the output bin sorter (Step S20).

On completion of recording by the image forming apparatus 1 (Yes in Step S21) , the control unit 37 fetches, from the custom setting table 41, the height of an output bin sorter associated with the user name. As already mentioned, this height is among the print conditions. Further, the control unit 37 controls the drive of the elevator drive unit 34 such that the output bin sorter which has received the printed paper is vertically displaced to the height associated with the user name, along with vertical displacement of an upper bin sorter which locates above this output bin sorter. Thereby, the two bin sorters are separated by a distance of about 10 cm (Step S22), which enables easy collection of recording paper from the output bin sorter.

Thereafter, the control unit 37 stands by until printed paper is collected from the output bin sorter (No in Step S23). Once the printed paper is collected (Yes in Step S23), the control unit 37 stands by for a next printing operation (Step S24).

To sort printed paper into more than one output bin sorter (Yes in Step S8), the control unit 37 controls the drive of the elevator drive unit 34 in such a manner as to lower the output bin sorters 32*a*–32*j* to their lowest positions, with the top output bin sorter 32*a* vertically displaced to the position Z2 in the output unit 36 (Step S9) . At this stage, it is possible to pull recording paper out of a certain feed bin sorter and to deliver recording paper to the output bin sorter 32*a*. In this situation, the pullout unit 35 pulls out pre-printed paper one sheet after another from the feed bin sorter and sends the paper to the recording paper transport unit 5. After the printer 4 records an image on each sheet of recording paper, the output unit 36 delivers the printed paper one sheet after another. Along with this operation, the control unit 37 controls the drive of the elevator drive unit 34 in such a manner as to raise the output bin sorter 32*a* timely, and also to raise the output bin sorters 32*b* . . . 32*j* timely and successively to the position Z2 in the output unit 36 (Step S10). Accordingly, recording paper is sorted into the output bin sorters.

On completion of recording by the image forming apparatus 1 (Yes in Step S11), the control unit 37 fetches, from the custom setting table 41, the height of an output bin sorter associated with the user name. As already mentioned, this height is among the print conditions. Further, the control unit 37 controls the drive of the elevator drive unit 34 such that the top output bin sorter 32*a* is vertically displaced to the height associated with the user name (Step S12). In this state, the control unit 37 stands by until recording paper is collected from the output bin sorter 32*a* (No in Step S13). Once the recording paper is collected (Yes in Step S13), the control unit 37 vertically displaces the next output bin sorter 32*b* to the height associated with the user name, along with vertical displacement of the output bin sorter 32*a* which locates above. With the output bin sorters 32*a*, 32*b* being thus separated by a distance of about 10 cm (Step S14), the control unit 37 stands by until recording paper is collected from the output bin sorter 32*b* (No in Step S15).

Steps S14, S15 are repeated for collection of recording paper from each output bin sorter which has received printed paper. After printed paper is collected from all output bin sorters (Yes in Step S15), the control unit 37 stands by for a next printing operation (Step S24).

Further, it is supposed that a printing operation is not permitted under the entered user name (No in Step S4) or that the heights of a feed bin sorter and an output bin sorter are not set in association with this user name (No in Step S5). In this case, the control unit 37 fetches, from the custom setting table 41, the height of an output bin sorter associated with the default user name, and sets the fetched value as such (Step S30). Further, the control unit 37 determines whether any feed bin sorter stores recording paper whose size agrees to a relevant print condition (Step S31). If there is a corresponding feed bin sorter (Yes in Step S31) , the control unit 37 controls the drive of the elevator drive unit 34 in such a manner as to vertically displace the corresponding feed bin sorter to the position Z1 in the pullout unit 35 (Step S32). Consequently, recording paper can be pulled out of the corresponding feed bin sorter.

If there is no corresponding feed bin sorter (No in Step S31) , the control unit 37 selects any of the feed bin sorters 31*a*–31*d*. Further, the control unit 37 controls the drive of the elevator drive unit 34 such that the selected feed bin sorter is vertically displaced to the height associated with the default user name, along with vertical displacement of an upper bin sorter which locates above the selected feed bin sorter. Thereby, the two bin sorters are separated by a distance of about 10 cm (Step S41). Thereafter, the control unit 37 stands by until the selected feed bin sorter is loaded with recording paper whose size agrees to a relevant print condition (No in Step S42). Once proper recording paper is loaded (Yes in Step S42), the control unit 37 vertically displaces the selected feed bin sorter to the position Z1 in the pullout unit 35 (Step S43). Consequently, recording paper can be pulled out of the selected feed bin sorter.

In the next step, the control unit 37 refers to a relevant print condition and decides whether to sort printed paper into more than one output bin sorter (Step S33). To deliver printed paper simply to an output bin sorter (No in Step S33), the control unit 37 controls the drive of the elevator drive unit 34 in such a manner as to vertically displace the output tray 33 to the position Z3 in the output unit 36 (Step S44). At this stage, it is possible to pull recording paper out of a certain feed bin sorter and to deliver recording paper to the output tray 33. In this situation, the pullout unit 35 pulls out pre-printed paper from the feed bin sorter and sends the paper to the recording paper transport unit 5. After the printer 4 records an image on this recording paper, the output unit 36 delivers the printed paper to the output tray 33 (Step S45).

On completion of recording by the image forming apparatus 1 (Yes in Step S46) , the control unit 37 stands by for a next printing operation (Step S24).

To sort printed paper into more than one output bin sorter (Yes in Step S33) , the control unit 37 lowers the output bin sorters 32*a*–32*j* to their lowest positions, with the top output bin sorter 32*a* vertically displaced to the position Z2 in the output unit 36 (Step S34). At this stage, it is possible to pull recording paper out of a certain feed bin sorter and to deliver recording paper to the output bin sorter 32*a*. In this situation, the pullout unit 35 pulls out pre-printed paper one sheet after another from the feed bin sorter and sends the paper to the recording paper transport unit 5. After the printer 4 records an image on each sheet of recording paper, the output unit 36 delivers the printed paper one sheet after another. Along with this operation, the control unit 37 raises the output bin sorter 32*a* timely, and also raises the output bin sorters 32*b* . . . 32*j* timely and successively to the position Z2 in the output unit 36 (Step S35). Accordingly, recording paper is sorted into the output bin sorters.

On completion of recording by the image forming apparatus 1 (Yes in Step S36) , the control unit 37 fetches, from the custom setting table 41, the height of an output bin sorter associated with the default user name. Further, the control unit 37 vertically displaces the top output bin sorter 32*a* to the height associated with the default user name (Step S37). In this state, the control unit 37 stands by until recording paper is collected from the output bin sorter 32*a* (No in Step S38). Once the recording paper is collected (Yes in Step S38) , the control unit 37 vertically displaces the next output bin sorter 32*b* to the height associated with the default user name, along with vertical displacement of the output bin sorter 32*a* which locates above. With the output bin sorters 32*a*, 32*b* being thus separated by a distance of about 10 cm (Step S39), the control unit 37 stands by until recording paper is collected from the output bin sorter 32*b* (No in Step S40).

Steps S39, S40 are repeated for collection of recording paper from each output bin sorter which has received printed paper. After printed paper is collected from all output bin sorters (Yes in Step S40), the control unit 37 stands by for a next printing operation (Step S24).

Figure 8:
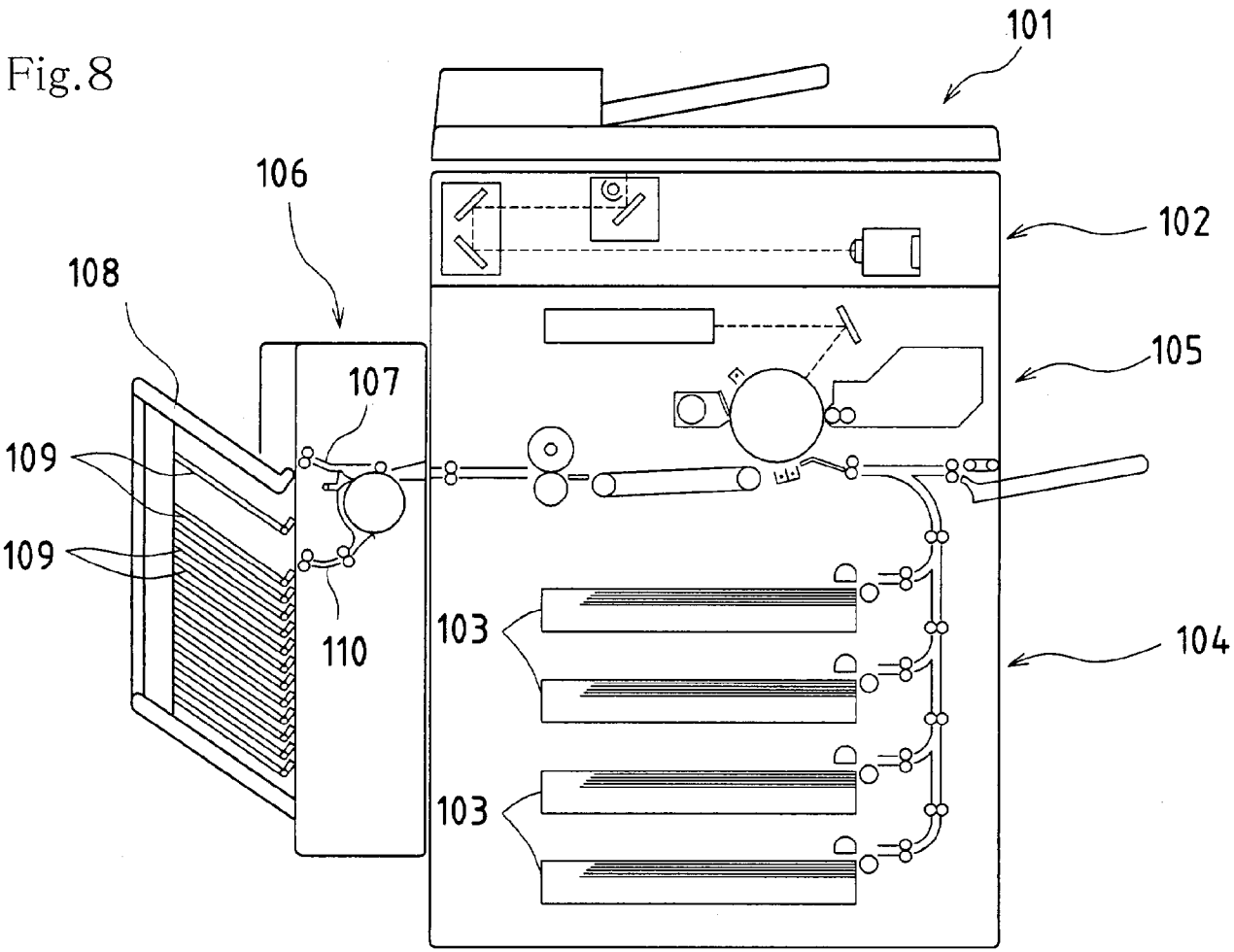
FIG. 8 is a side view which exemplifies a conventional image forming apparatus.

As has been described, the image forming apparatus 1 of this embodiment is equipped with feed bin sorters, output bin sorters, and an output tray, which are arranged in tiers. This image forming apparatus 1 supplies pre-printed paper from any of the feed bin sorters, and delivers printed paper to any of the output bin sorters or the output tray. In contrast to the conventional image forming apparatus shown in FIG. 8, the image forming apparatus 1 can do without conventional paper cassettes and is therefore available in a reduced size. In addition, the feed bin sorters and the output bin sorters can be raised or lowered to suitable heights and can be separated from each other. This arrangement facilitates loading of pre-printed paper into the feed bin sorters and collection of printed paper from the output bin sorters.

The invention may be embodied in other specific forms without departing from the spirit or essential characteristics thereof. The above embodiment is therefore to be considered in all respects as illustrative and not restrictive, the scope of the invention being indicated by the appended claims rather than by the foregoing description. All changes which come within the meaning and range of equivalency of the claims are therefore intended to be embraced therein.

This application is based on Patent Application No. 2002-171674 filed in Japan, the contents of which are incorporated hereinto by reference.

What is claimed is:

1. A paper feed and output assembly attached to an image forming apparatus, for supplying paper to the image forming apparatus and receiving printed paper therefrom, the paper feed and output assembly comprising:

a plurality of feed bin sorters for storing recording paper;

a plurality of output bin sorters for storing printed paper; and hold and elevation means for holding the plurality of feed bin sorters and the plurality of output bin sorters stacked vertically together in tiers that are vertically displaceable with respect to each other, and for vertically displacing any one of the plurality of feed bin sorters to a feed position in the image forming apparatus and vertically displacing any one of the plurality of output bin sorters to an output position in the image forming apparatus.

2. A paper feed and output assembly attached to an image forming apparatus, for supplying paper to the image forming apparatus and receiving printed paper therefrom, the paper feed and output assembly comprising:

a plurality of feed bin sorters for storing recording paper;

a plurality of output bin sorters for storing printed paper; and hold and elevation means for holding the plurality of feed bin sorters and the plurality of output bin sorters in tiers and in a vertically displaceable manner, and for vertically displacing any one of the plurality of feed bin sorters to a feed position in the image forming apparatus and vertically displacing any one of the plurality of output bin sorters to an output position in the image forming apparatus, wherein when recording paper is loaded in any one of the plurality of feed bin sorters, the hold and elevation means separates the feed bin sorter to be loaded with recording paper, and an upper bin sorter which is located above the feed bin sorter to be loaded with recording paper.

3. The paper feed and output assembly according to claim 2, wherein the hold and elevation means vertically displaces the feed bin sorter to be loaded with recording paper, to a position which is prescribed in advance.

4. The paper feed and output assembly according to claim 1, wherein the hold and elevation means separates any one of the plurality of output bin sorters which has received printed paper from the image forming apparatus, and an upper bin sorter which is located above the output bin sorter which has received printed paper.

5. The paper feed and output assembly according to claim 4, wherein the hold and elevation means vertically displaces the output bin sorter which has received printed papers, to a position which is prescribed in advance.

6. An image forming apparatus which comprises a paper feed and output assembly, and which receives recording paper from the paper feed and output assembly and delivers printed paper thereto, the paper feed and output assembly comprising:

a plurality of feed bin sorters for storing recording paper;

a plurality of output bin sorters for storing printed paper; and hold and elevation means for holding the plurality of feed bin sorters and the plurality of output bin sorters stacked vertically together in tiers that are vertically displaceable with respect to each other, and for vertically displacing any one of the plurality of feed bin sorters to a feed position in the image forming apparatus and vertically displacing any one of the plurality of output bin sorters to an output position in the image forming apparatus.

* * * * *